United States Patent [19]

Oliviero

[11] Patent Number: 4,590,691

[45] Date of Patent: May 27, 1986

[54] DEVICE FOR PRESSING THE TONGUE OF A SKI BOOT ON TO THE INSTEP OF THE WEARER OF THE BOOT

[75] Inventor: Olivieri Oliviero, Montebelluna, Italy

[73] Assignee: Icaro Olivieri & C. S.p.A., Montebelluna, Italy

[21] Appl. No.: 693,340

[22] Filed: Jan. 22, 1985

[30] Foreign Application Priority Data

Jan. 23, 1984 [IT] Italy ..... 19273 A/84

[51] Int. Cl.[4] ..... A43B 5/04; A43B 23/26

[52] U.S. Cl. ..... 36/119; 36/54; 24/641

[58] Field of Search ..... 36/117–121, 36/54; 24/641

[56] References Cited

U.S. PATENT DOCUMENTS 2,951,274 9/1960 Ezsner ..... 24/641 X
3,883,964 5/1975 Check ..... 36/119
4,193,215 3/1980 Hensler ..... 36/117 X
4,406,073 9/1983 Spademan ..... 36/119

FOREIGN PATENT DOCUMENTS 1806109 5/1970 Fed. Rep. of Germany ..... 36/120

*Primary Examiner*—James Kee Chi
*Attorney, Agent, or Firm*—Fleit, Jacobson, Cohn & Price

[57] ABSTRACT

A device for tightening ski boots is described including a curved plate attached to the tongue of the ski boot, a threaded shank fixed to the plate and an operating knob for the shank, rotatably supported externally of the ski boot and provided with a nut screwed on to the threaded shank so as to permit gradual tightening or loosening. The nut is of the splitnut type which can be opened out, and the knob includes a device which, by opening the splitnut, allow the rapid release of the pressure on the tongue of the ski boot and, hence, on the instep of the wearer's foot.

10 Claims, 10 Drawing Figures

DEVICE FOR PRESSING THE TONGUE OF A SKI BOOT ON TO THE INSTEP OF THE WEARER OF THE BOOT

The present invention relates to a device for pressing the tongue of a ski boot on to the instep of the wearer's foot, which device is of the type including a plate positioned on the tongue of the ski boot, a threaded shank fixed to the plate and an operating knob for the shank rotatably supported externally of the boot and screwed on to the threaded shank.

Tightening devices of the aforesaid type are currently being used with increasing frequency on ski boots.

These devices have recognised advantages over conventional tightening systems, which advantages, in particular, comprise extreme simplicity of use and the possibility of gradual and very accurate adjustment.

But although gradual adjustment of the tightening force is very desirable during fastening of the boot on to the user's foot, it is not equally so during release. In fact, after sporting exercise, which is often vigorous, such as that for which the type of ski boot under consideration is particularly intended, the skier feels the need to loosen the boot as quickly as possible. With known devices, loosening takes place gradually just like the tightening. Furthermore, any incrustations of snow and ice may make this loosening very difficult, if not downright impossible.

There is thus a problem of producing a ski-boot tightening device of the type considered above, which allows the tightening to be loosened rapidly and easily when required.

This problem is solved according to the invention by a device comprising a plate positioned on the tongue of the ski boot, a threaded shank fixed to the plate and an operating knob for the shank rotatably supported externally of the boot and screwed on to the threaded shank, characterised in that the knob incorporates a nut of, essentially, the splitnut type which can be opened out, the knob further including means for opening out the splitnut.

In order to show further characteristics and advantages of a device according to the invention, there will be described below two preferred embodiments, illustrated in the appended drawings, purely by way of example, and in which.

Figure 1:
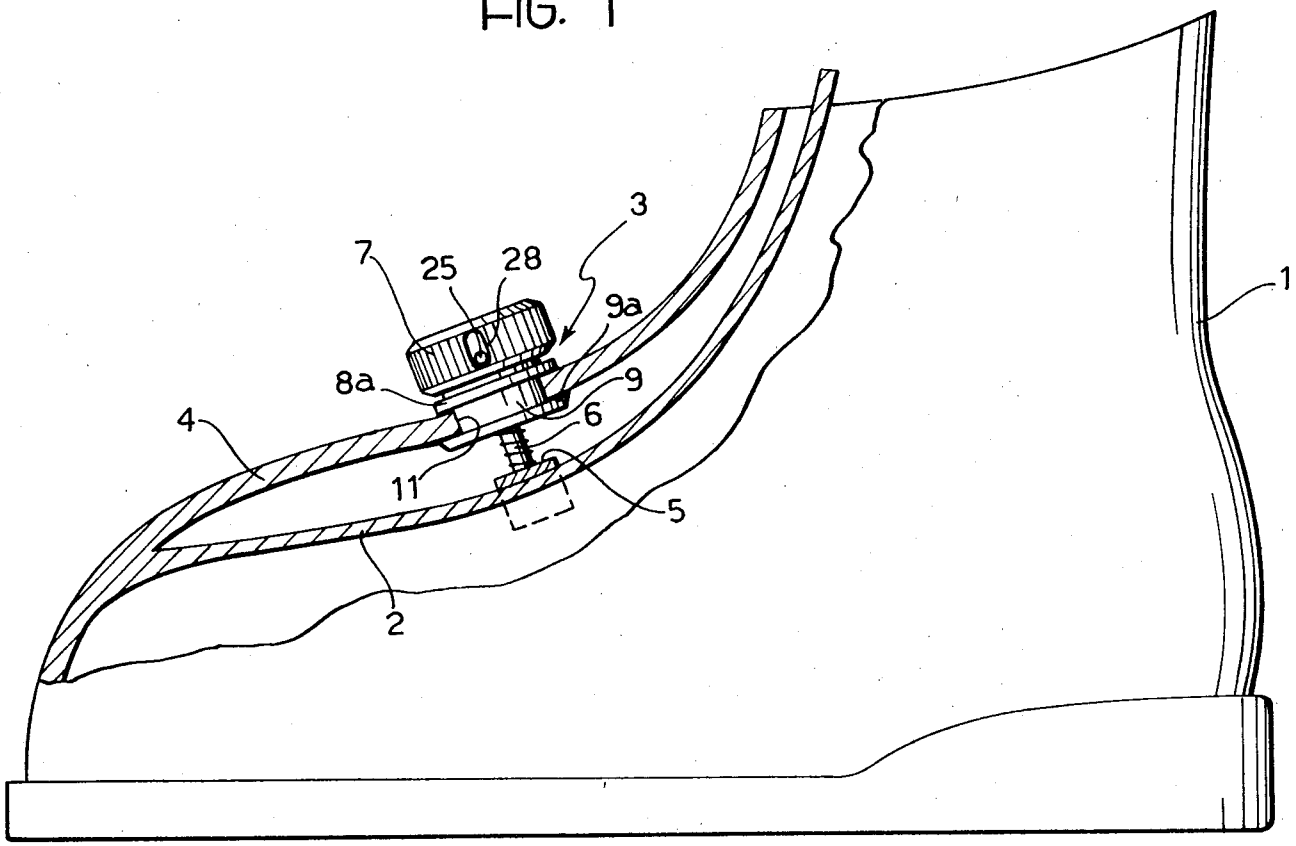
FIG. 1 is a partially-sectioned schematic view of a ski boot equipped with a device according to a first embodiment of the invention.
Figure 2:
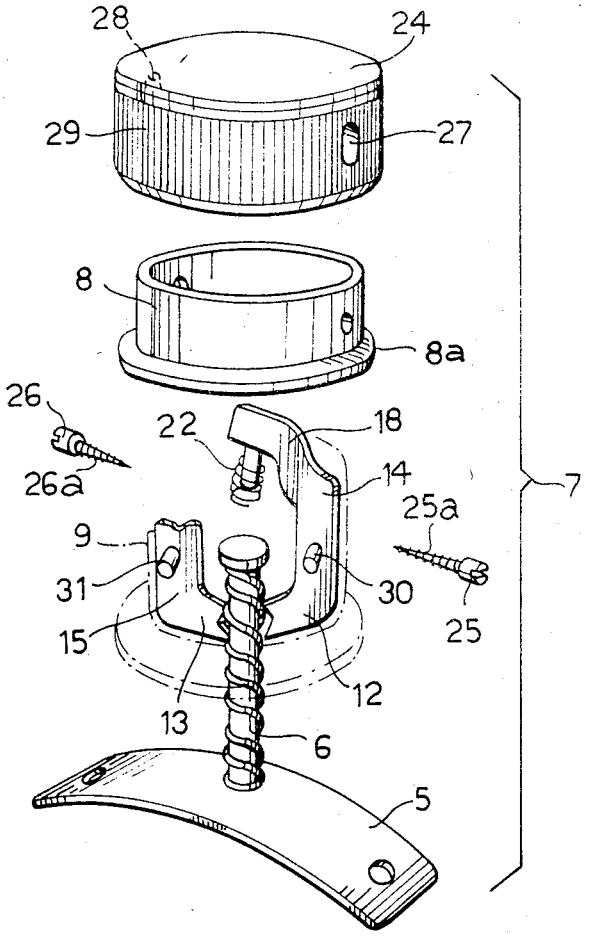
FIG. 2 is a partially-sectioned perspective view of the device according to the invention, with the parts separated.

With reference to FIG. 1, a ski boot 1 is shown comprising an upper 4 and a tongue 2 extending within the upper in correspondence with the instep thereof. This tongue 2 may be tightened on the foot of the wearer of the ski boot by means of a device, generally indicated 3, supported by the upper 4 in the manner described below.

With reference to FIGS. 1 to 7, the tightening device 3 comprises a curved metal plate 5 attached to the tongue 2 and provided with a threaded shank 6 projecting outwardly of the upper 4.

The shank 6 is engaged in a knob generally indicated 7 rotatably supported by the upper 4 of the boot 1. The knob 7 comprises two cylindrical, coaxial bodies 8 and 9 having flanged ends 8*a* and 9*a* respectively (FIGS. 6 and 7) fixed together during assembly of the device. Between the flanged ends 8*a* and 9*a* of the bodies 8 and 9 there is an annular seat 10 for the coupling of the knob 7 with a through-hole 11 formed in an appropriate position in the instep portion of the upper 4. This coupling is of the type which allows the knob 7 to rotate relative to the upper 4 but not to be separated therefrom.

The knob 7 comprises a nut of the splitnut type, which can be opened out, for engagement with the threaded shank 6. The nut comprises a pair of toothed portions 12, 13 of two plate-shaped jaws 14, 15 extending along opposite sides of the threaded shank 6 and supported by the body 9 so as to be displaceable angularly towards and away from the threaded shank 6, as will become apparent from the description below.

Figure 7:
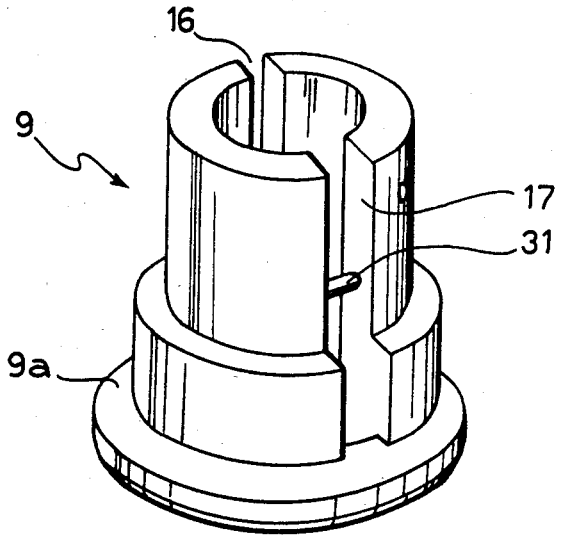
FIG. 7 is a perspective view of a detail of FIG. 6.

With reference to FIG. 7, the cylindrical body 9, within which the threaded shank 6 extends coaxially, has two diametrally-opposed, longitudinal slits 16, 17 within which the plate-shaped jaws 14 and 15 respectively are pivoted by means of corresponding pins 30, 31. The plate-shaped jaws 14 and 15 are angularly displaceable about the pins 30, 31, in a diametral plane of the body 9, so as to carry the respective toothed portions 12 and 13 (splitnut portions of the nut) into engagement with the threaded shank 6 or into positions disengaged therefrom.

Figure 3:
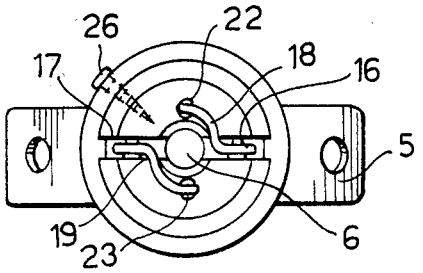
FIG. 3 is a view from above of a detail of the device of FIG. 2.
Figure 4:
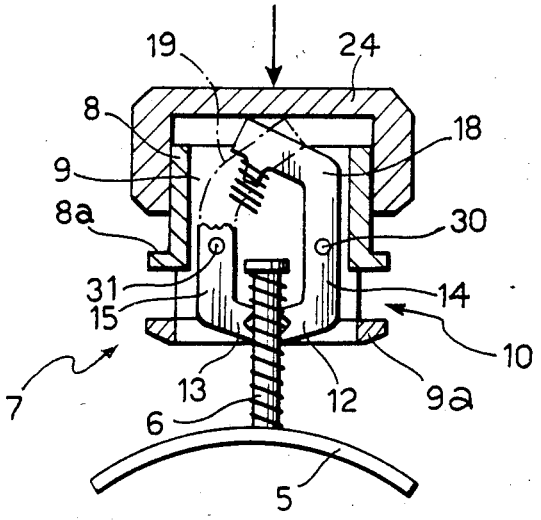
FIG. 4 is a sectional view of the device of FIG. 2 in a tightened state.
Figure 5:
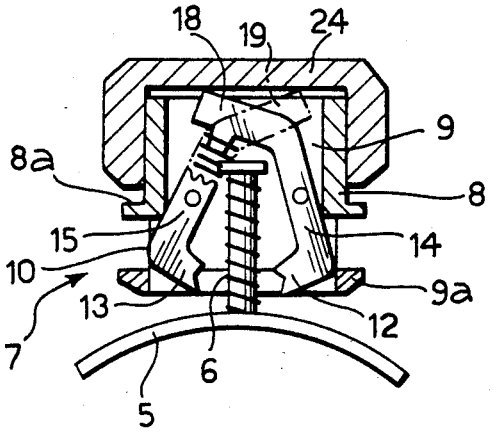
FIG. 5 is a sectional view of the device of FIG. 4 in a non-tightened state.
Figure 6:
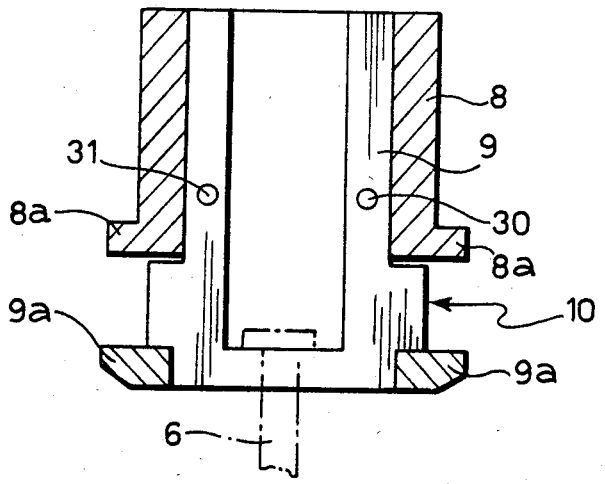
FIG. 6 is a sectional view, on an enlarged scale, of a structural detail of the device of FIG. 2.

At their ends opposite the toothed portions 12, 13, the plate-shaped jaws 14 and 15 include respective arms 18, 19 bent towards the shank 6 and curved thereabout (FIG. 3). A substantially cap-shaped push button 24 having a knurled outer surface 29 is fitted on to the body 8 of the knob 7 and is guided for axial movement on the body 8 by means of two pins 25 and 26 fixed to the body 8 and engaged in respective slots 27, 28 formed longitudinally in the push button 24. In particular, the pins 25 and 26 are constituted by the cylindrical heads of corresponding screws 25*a* and 26*a*. By means of the push button 24 the whole knob 7 may be rotated in one sense or the other with respect to the upper 4.

The push button 24 acts on the arms 18 and 19 of the plate-shaped jaws 14 and 15. If the push button 24 is pressed on to the arms 18 and 19, the plate-shaped jaws 14 and 15 are displaced angularly about their respective pins 30 and 31, against the action of spring means 22, 23, into the position in which they are disengaged from the threaded shank 6.

Figure 8:
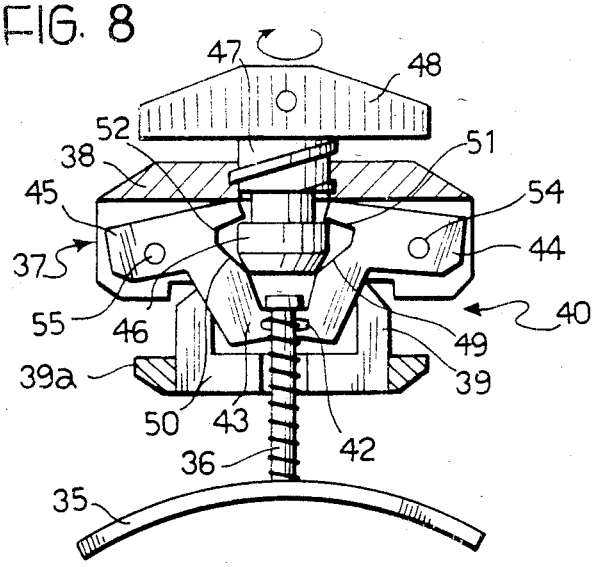
FIG. 8 is a sectional view of a second embodiment of a device according to the invention in a tightened state.
Figure 9:
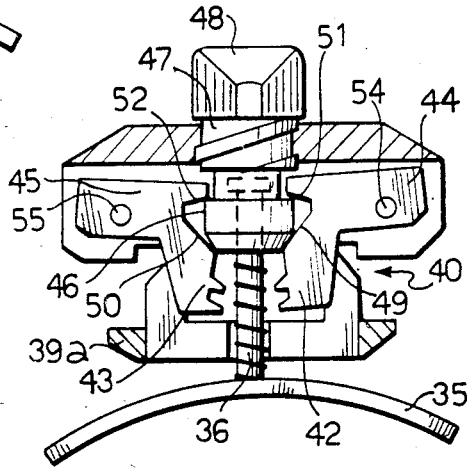
FIG. 9 is a section similar to that of FIG. 8 of the device of the invention in a non-tightened state.

The tightening device illustrated in FIGS. 8 and 9 comprises a curved metal plate 35 with a threaded shank 36 housed in a knob generally indicated 37. The knob 37 comprises two cylindrical, coaxial bodies 38 and 39 fixed to each other during the assembly of the tightening device under consideration. The body 39 has an annular flange 39*a*, which, with the body 38, defines a seat 40 for the coupling of the knob 37 in a through-hole 11 formed in the upper 4 of a ski boot.

The knob 37 includes a nut of the splitnut type, which can be opened out, for engagement with the threaded shank 36, as will become clearer from the following part of the description. In particular, the portions of the splitnut which can be opened apart are constituted by respective toothed portions 42 and 43 of two plate-shaped jaws 44 and 45 extending along opposite sides of the threaded shank 36 and supported by the body 38 so as to be angularly displaceable towards and away from the threaded shank, as will become apparent from the description which follows. In particular, in a manner similar to that of the device shown in FIGS. 1 to 7, the cranked, plate-shaped jaws 44 and 45 are pivoted on respective pins 54, 55 fixed transversely in respective slits formed longitudinally in diametrally opposed positions in the body 38.

Along their sides facing the axis of the knob 37, the plate-shaped jaws 44 and 45 have first cam surfaces 49 and 50 respectively and second cam surfaces 51 and 52 respectively, spaced from the former by a distance capable of accommodating a slide 46 formed at the free end of a threaded shaft 47 having a rapid-pitch thread screwed into a threaded hole formed in the body 38. Outside the body 38, the threaded shaft 47 has a control wheel 48. The slide 46 and the entire threaded shaft 47 have axial bores to allow the free passage of the threaded shank 36.

The slide 46 has such a size and shape as to engage the cam surfaces 49 and 50 or 51 and 52, in cooperation with which it causes the toothed portions 42 and 43 to open apart or to close together so as to constitute a nut for the threaded shank 36.

It should be noted that the rapid-pitch thread of the threaded shaft 47 has a right-handed helix, contrary to the left-handed one of the threaded shank 36.

Figure 10:
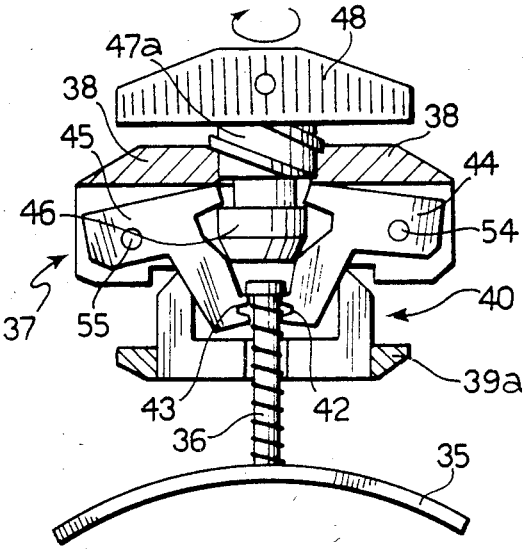
FIG. 10 is a section of a variant of the device of FIG. 8.

The tightening device of FIG. 10 is wholly identical to that described with reference to FIGS. 8 and 9, with the sole exception that the threading of the threaded shaft 47*a* has a left-handed helix like that of the threaded shank 36.

In the device illustrated in FIGS. 1 to 7, rotation of the knob 7 in a clockwise sense causes the lowering of the shank 6 with its curved plate 5 on the tongue 2, pressing the latter on to the instep of the skier's foot. On the contrary, rotation of the knob 7 in an anticlockwise sense causes a slackening of the pressure of the plate 5 on the tongue 2. These operations, both tightening and loosening, are effected gradually because of the engagement, which may be micrometric, of the openable splitnut with the threaded shank 6.

When it is wished to loosen the device rapidly, it suffices to press the push button 24. With this action, the plate-shaped jaws 14 and 15 are displaced angularly about their respective pins 30 and 31, away from the threaded shank 6 which is thus disengaged from the portions 12 and 13 of the splitnut. In this condition, the shank 6 may enter the knob 7 freely, urged by the pressure of the skier's foot on the plate 5 through the tongue 2. On release of the push button 24, the jaws 14 and 15, thrust by the springs 22 and 23, return the respective toothed portions 12, 13 (splitnut portions) into screw engagement with the threaded shank 6.

For the tightening device illustrated in FIGS. 8 to 10, the tightening and loosening operations, carried out with gradual and controlled adjustment, take place in a manner entirely similar to that of the device of FIGS. 1 to 7.

When rapid loosening is required, it suffices to rotate the threaded shaft 47 relative to the knob 37 by means of the control wheel 48. In particular (FIGS. 6, 7) rotation of the threaded shaft 47 in a clockwise sense causes the rapid insertion of the slide 46 between the plate-shaped jaws 44 and 45 and the consequent opening of the splitnut (toothed portions 42 and 43). The threaded shank 36 is thus free to re-enter the knob 7 under the pressure of the wearer's foot on the plate 35.

On rotation of the control wheel 48 in the opposite sense from the preceding one, the slide 46 is returned rapidly in the opposite direction from the preceding one and acts on the second cam surfaces 51, 52, to cause the plate-shaped jaws 44, 45 to move angularly relative to the pins 54 and 55, with the consequent closing of the jaw portions 42 and 43 on the threaded shank 36.

In order to carry out the operations just described with the device of FIG. 10, it is necessary to turn the control wheel 48 in the opposite sense. It should be noted that, in this case, the tightening operation with the gradual adjustment of the tightening force, may be carried out solely by operation of the control wheel 48 whilst, for gradual loosening,, it is necessary to operate the knob 37.

What is claimed is:

1. A device for pressing the tongue of a ski boot on to an instep of a wearer of the boot, said device comprising:

a plate attached to said tongue, a threaded shank fixed to said plate, an operating knob for said threaded shank, said operating knob being supported for rotation externally of said boot, a splitnut incorporated in said knob and said splitnut being screwed onto said threaded shank to gradually move said plate away from said knob, and means for opening said splitnut to rapidly disengage said splitnut from said threaded shank.

2. A device as claimed in claim 1, wherein said splitnut is constituted by plate-shaped jaws having respective toothed portions for engaging said threaded shank, said jaws being pivotally supported in said knob.

3. A device as claimed in claim 2, wherein said plate-shaped jaws extend along opposite sides of said threaded shank, said means for opening said splitnut being arranged to displace said plate-shaped jaws angularly from a position in which said toothed portions are closed on said threaded shank to a position in which they are spaced from said threaded shank.

4. A device as claimed in claim 3, wherein each said toothed portion is formed at one end of the respective plate-shaped jaw and each said jaw has an arm at its end opposite said toothed portion, wherein said means for opening said splitnut comprise a push button movable axially of said knob in contact with said arms and wherein resilient means act on said arms in opposition to said push button.

5. A device as claimed in claim 3, wherein each said plate-shaped jaw has a cam-surface along its side facing said threaded shank and said means for opening said splitnut comprise a slide movable axially between said plate-shaped jaws in engagement with said cam surfaces.

6. A device as claimed in claim 5, wherein said slide is formed at the end of a threaded shaft having a rapid-pitch thread in screw engagement with said knob.

7. A device as claimed in claim 6, wherein said slide and said threaded shaft define axial through-holes in which said threaded shank can be received axially with clearance.

8. A device as claimed in claim 6, wherein said threaded shaft has a thread which matches the thread of said threaded shank.

9. A device as claimed in claim 6, wherein said threaded shaft has a rapid-pitch thread which does not match that of said threaded shank.

10. A device as claimed in claim 6, wherein said threaded shank is operated by means of a control wheel accessible externally of said knob.

* * * * *